US007159650B2

(12) United States Patent
Brost et al.

(10) Patent No.: US 7,159,650 B2
(45) Date of Patent: Jan. 9, 2007

(54) HEAT EXCHANGER

(75) Inventors: Viktor Brost, Aichtal (DE); Stanislaus Lesjak, Filderstadt (DE); Hans-Dieter Hartel, Steinenbronn (DE)

(73) Assignee: Modine Manufacturing Company, Racine, WI (US)

( * ) Notice: Subject to any disclaimer, the term of this patent is extended or adjusted under 35 U.S.C. 154(b) by 310 days.

(21) Appl. No.: 10/610,441

(22) Filed: Jun. 30, 2003

(65) Prior Publication Data

US 2004/0069475 A1 Apr. 15, 2004

(30) Foreign Application Priority Data

Jun. 28, 2002 (DE) ..... 102 29 083
Apr. 4, 2003 (EP) ..... 03007724

(51) Int. Cl.
*F28F 3/08* (2006.01)

(52) U.S. Cl. ..... 165/167; 165/172

(58) Field of Classification Search ..... 165/153, 165/166, 167, 172
See application file for complete search history.

(56) References Cited

U.S. PATENT DOCUMENTS

| | | | | |
|---|---|---|---|---|
| 3,627,039 | A * | 12/1971 | Tiefenbacher | 165/158 |
| 4,183,402 | A * | 1/1980 | Cotter | 165/175 |
| 6,012,512 | A | 1/2000 | Ghiani | |
| 6,250,380 | B1 * | 6/2001 | Strahle et al. | 165/167 |
| 6,293,337 | B1 * | 9/2001 | Strahle et al. | 165/166 |

FOREIGN PATENT DOCUMENTS

| | | | |
|---|---|---|---|
| DE | 4328930 | | 3/1995 |
| DE | 4431197 | | 8/1995 |
| DE | 10042895 | | 5/2001 |
| DE | 19962861 | | 6/2001 |
| EP | 0775884 | A2 | 5/1997 |
| EP | 0775884 | A3 | 10/1997 |
| EP | 0992756 | A2 | 4/2000 |
| EP | 0992756 | A3 | 12/2000 |
| EP | 1139052 | | 10/2001 |
| WO | 0075591 | | 12/2000 |

* cited by examiner

*Primary Examiner*—Allen J. Flanigan
(74) *Attorney, Agent, or Firm*—Wood, Phillips, Katz, Clark & Mortimer

(57) ABSTRACT

A heat exchanger (20) includes a stack (22) of heat exchanger tubes (24), with the stack (22) having a pair of spaced ends (26, 28) that are received into respective manifolds (30, 32) that direct a first fluid (33), such as an exhaust gas flow of a vehicle, to and from interiors (34) of the tubes (24). The manifolds (30) and (32) are bonded to the respective ends (26) and (28) using a suitable bonding technique, such as soldering. Each end (26, 28) has an outer periphery (54) that includes furrows (56) and elongate, narrow protrusions (58), and each manifold (30, 32) has a wall (60) that extends continuously around the associated end (26, 28) and includes inwardly directed ridges (62) that are received in the furrows (56) and elongate slots (64) that receive the protrusions (58) to provide a tight joint between the wall (60) and the associated end (50, 52). Preferably, the ridges (62) and slots (64) extends longitudinally along the wall (60) a sufficient distance to allow the wall (60) to be pushed over a length of the associated end (26, 28) sufficient to provide an adequately large joining surface between the wall (60) and the associated end (26, 28), thereby allowing for a qualitatively high-grade soldering connection.

16 Claims, 9 Drawing Sheets

HEAT EXCHANGER

RELATED APPLICATIONS

This application claims priority to DE 102 29 083.0, filed Jun. 28, 2002 and naming Viktor Brost, Stanislaus Lesjak, and Hans-Dieter Hartel as inventors. The entire disclosure of this priority document is incorporated herein by reference.

FIELD OF THE INVENTION

This invention relates to heat exchangers in general, and in more particular applications to so called "headerless" heat exchangers that directly connect the heat exchanger tubes or plates to a manifold or tank, rather than indirectly through a header plate.

BACKGROUND OF THE INVENTION

Headerless heat exchangers that directly connect the heat exchanger tubes or plates to a manifold or tank that distributes and/or collects the working fluid to and/or from the tubes are know. Some examples of such constructions can be seen in WO 00/75591, EP 0 775 884 A2, and EP 1 139 052 A2. Each of these constructions involves a stack of flat heat exchanger tubes that have deformed tube ends that abut against each other to form bonded, sealed joints that eliminate the need for a header plate. The manifolds in these examples include straight side walls that abut side surfaces of the stacked tubes to form a bonded, sealed joint therewith. U.S. Pat. No. 6,012,512 discloses several additional example of such heat exchangers, with some of the examples differing from the foregoing examples in that their manifolds have corrugated or V-shapes side walls that engage correspondingly shaped surfaces on the ends of the tubes in the stack. Typically, the foregoing examples are bonded by suitable soldering methods, such as by brazing. Additionally, the flow path for the second fluid in all the foregoing examples is an open flow path, typically for air, rather than an enclosed flow path such as is provided by so called stacked plate heat exchangers, one example of which is shown in EP 0 992 756 A2 and which utilizes a header plate (15).

While the foregoing examples may perform well for their intended function, there is always room for improvement. For example, there is a continuing desire to simplify the assembly and manufacture of such heat exchanger, such as by allowing the tubes to be formed from pairs of tube halves such as in stacked plate heat exchangers , and/or allowing such constructions to be preassembled and held together for a suitable soldering method with a minimum or no additional holding fixtures required.

SUMMARY OF THE INVENTION

In accordance with one aspect of the invention, a heat exchanger is provided and includes a stack of flat heat exchanger tubes having an end defined by the ends of the tubes of the stack, the tubes having interiors that direct a first fluid through the heat exchanger, and a manifold bonded to the end of the stack to direct the first fluid to or from the interiors of the tubes. The end of the stack has an outer periphery including at least one of furrows and elongate, narrow protrusions defined by outer peripheries of the ends of the tubes of the stack. The manifold includes a wall that extends continuously around the periphery of the end of the stack and is bonded thereto. The wall includes at least one of inwardly directed ridges that are received in the furrows and elongate slots that receive the protrusions to provide a tight joint between the wall and the periphery of the end of the stack.

In one form, the periphery of the end of the stack includes both the furrows and the protrusions extending parallel to each other, and the wall includes both the ridges and the slots extending parallel to each other and to the furrows and protrusions.

According to one aspect, adjacent pairs of tubes in the stack enclose flow paths for a second fluid through the heat exchanger.

In one form, at least one of the slots is defined by a fold in the wall.

In one aspect, at least one of the tubes includes a pair of mating tube halves and at least one of the protrusions is defined by mating edge flanges on the at least one pair of mating tube halves.

According to one aspect, at least one of the furrows is defined by a pair of rounded corners located at a joint between the ends of adjacent tubes in the stack In one form, at least one of the ridges is defined by an inwardly projecting, deformed indent in the wall.

According to one form, at least one of the slots is defined by a slit extending through the wall.

In one aspect, each of the ends of the tubes has a generally rectangular cross-section defined by a pair of parallel, spaced broad sides and a pair of parallel, spaced narrow sides. The broad sides of the ends of adjacent tubes are abutted against each other, and the ridges and the furrows are located in sections of the wall that extend along the narrow sides of the tubes.

According to one aspect, each of the ends of the tubes has a generally rectangular cross-section defined by a pair of parallel, spaced broad sides and a pair of parallel, spaced narrow sides. The broad sides of the ends of each pair of adjacent tubes face each other with a spacer located therebetween.

In one form, the heat exchanger further includes a top plate overlaying a side of an uppermost tube in the stack and defining an upper surface of the heat exchanger, and a bottom plate overlaying a side of a lowermost tube in the stack and defining a lower surface of the heat exchanger. The manifold further includes a pair of flanges with one of the flanges extending from the wall to overlie an end of the top plate, and the other of the flanges extending from the wall to overlie an end of the bottom plate.

In one form, at least one of the extensions has a gradation and at least one of the ends of the top and bottom plates has a pair of tabs that are bent to engage the gradation of the associated extension. In a further form, the top plate and the side of the uppermost tube enclose a flow path for a second fluid that is directed through the heat exchanger, and the bottom plate and the side of the lowermost tube also enclose a flow path for the second fluid.

According to one form, the manifold is a deep drawn metal component.

According to one aspect, adjacent pairs of tubes in the stack enclose flow paths for a second fluid through the heat exchanger, and at least one of the ridges or slots in the wall of the manifold are interrupted along their length by an outwardly expanded portion of the wall. The expanded portion encloses a chamber for directing the second fluid to or from the flow paths. In a further aspect, a fluid port extends from the expanded portion to direct the second fluid to or from the heat exchanger.

Other objects, advantages, and features of the invention will be come apparent from the entire specification, including the appended drawings and claims.

DETAILED DESCRIPTION OF THE PREFERRED EMBODIMENTS

Figure 1:
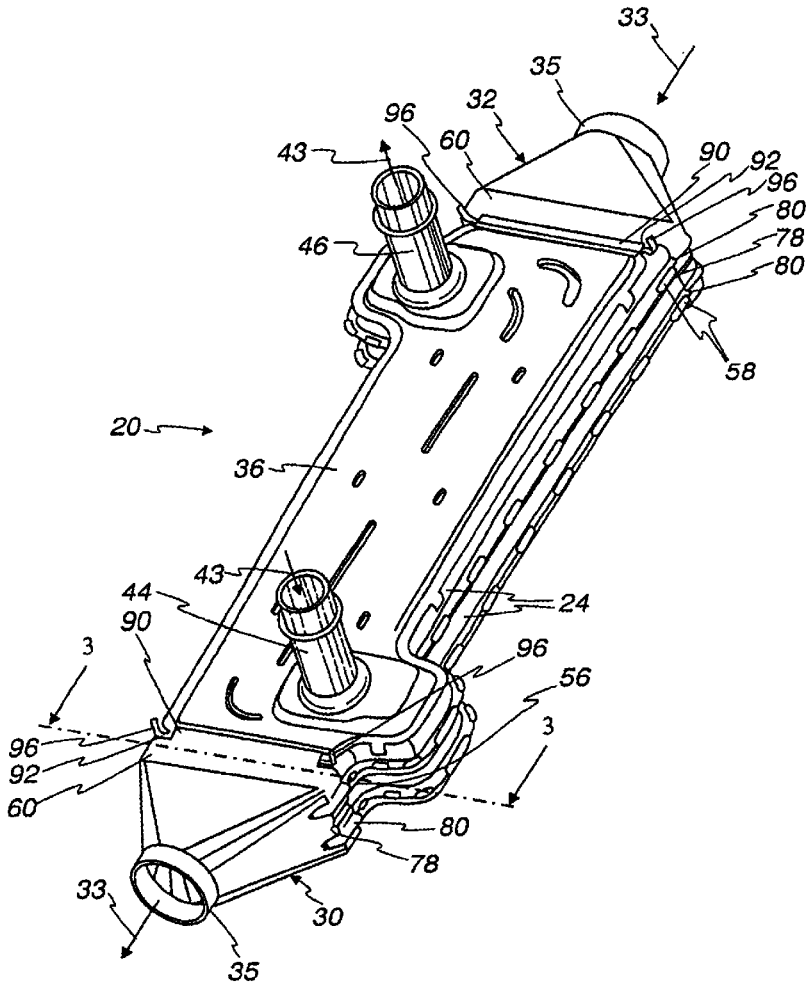
FIG. 1 is a perspective view of a heat exchanger embodying the present invention.
Figure 2:
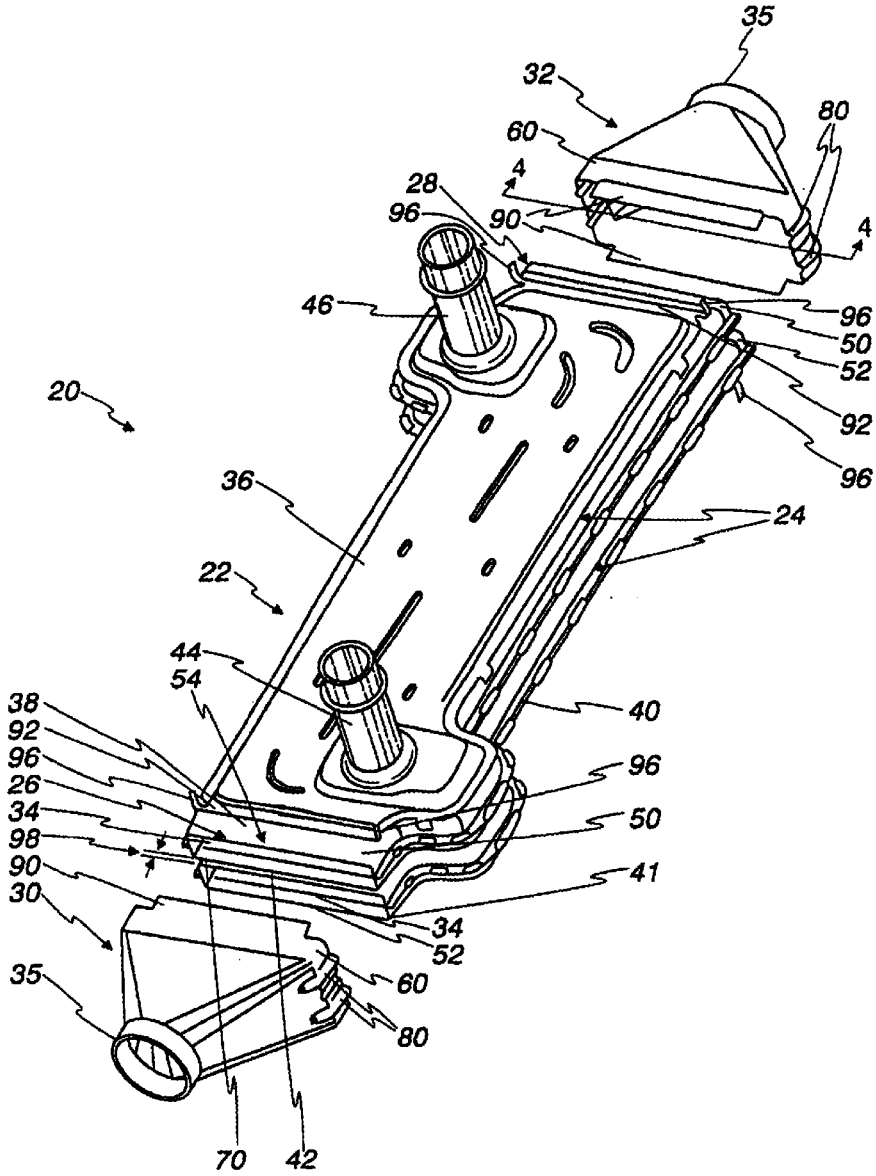
FIG. 2 is a partially exploded perspective view of the heat exchanger of FIG. 1.

With reference to FIGS. 1 and 2, a heat exchanger 20 embodying the present invention is shown and is intended for use as an exhaust heat exchange that is cooled with a coolant and which is incorporated into an exhaust gas recirculation system of a vehicle. The heat exchanger 20 can also be used with the same advantages as a charge air cooler that is cooled with a coolant. However, it should be understood that while some particular applications have been discussed, the heat exchangers 20 illustrated herein as well as other heat exchangers embodying the invention will prove useful in any number of applications where heat must be transferred between two or more fluids and that no limitation to use as an exhaust gas or charger air heat exchanger is intended unless expressly recited in the claims.

As best seen in FIG. 2, the heat exchanger 20 includes a stack 22 of two heat exchanger tubes 24, with the stack 22 having a pair of spaced ends 26, 28 that are received into respective manifolds 30, 32 that direct a first fluid 33, such as an exhaust gas flow of a vehicle, to and from interiors 34 of the tubes 24. The first fluid 33 is directed to and from the manifolds 30 and 32 by ports 35 formed on each of the manifolds 30 and 32. The manifolds 30 and 32 are bonded to the respective ends 26 and 28 using a suitable bonding technique, such as soldering. A top plate 36 overlays a side 38 of the uppermost tube 24 in the stack 22 and a bottom plate 40 overlays a side 41 of the lowermost tube 24 in the stack 22. The top and bottom plates 36 and 40 provide structural support for the stack 22 and cooperate with the respective sides 38 and 42 to enclose flow paths 42 for a second fluid 43, such as a coolant, that direct the second fluid 43 between fluid ports or couplings 44 and 46. An additional flow path 42 for directing the second fluid 43 between the couplings 44 and 46 is enclosed between the adjacent tubes 24. In this regard, it should be appreciated that while only two of the tubes 24 are shown, the stack could consist of any number of tubes 24 as dictated by the requirements of any particular application, with a flow path 42 for the second fluid 43 defined between each adjacent pair of the tubes 24.

Figure 3:
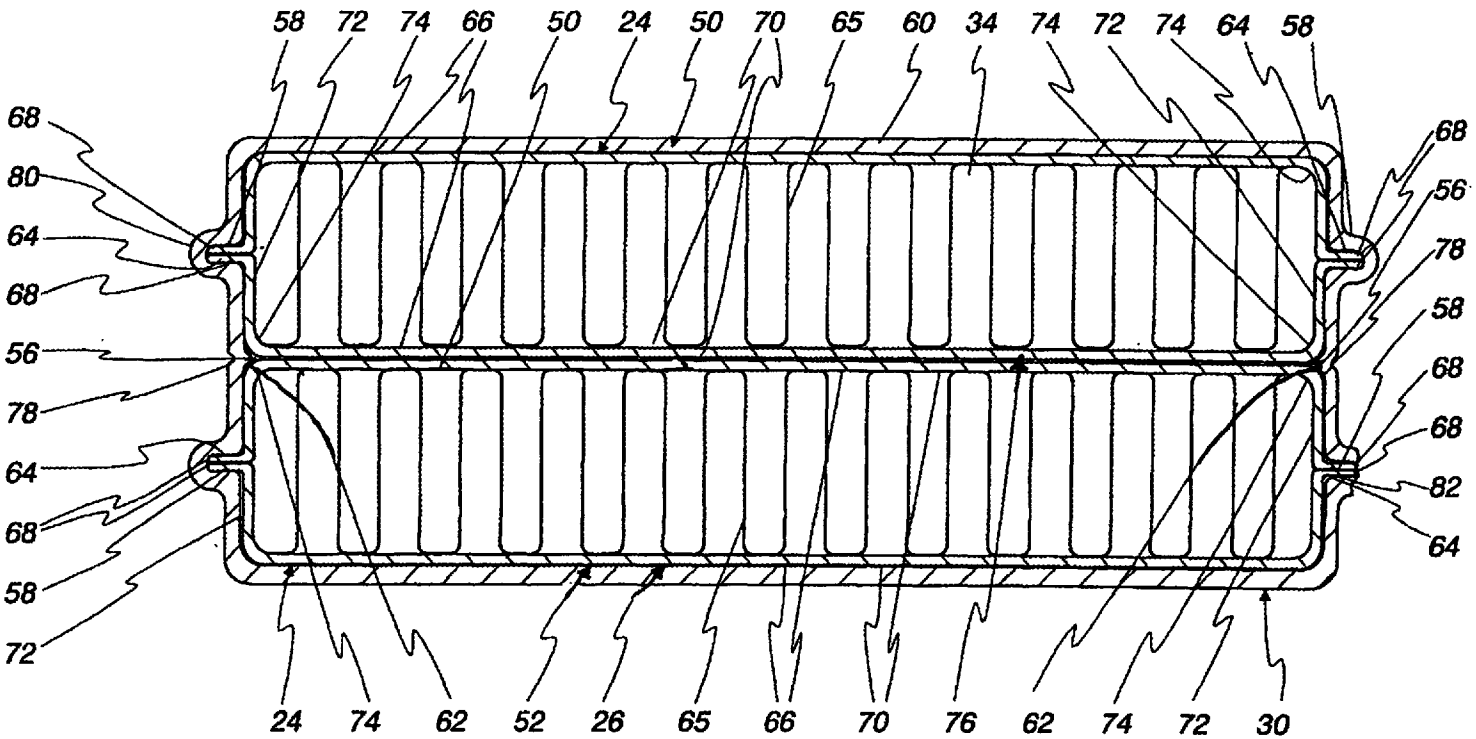
FIG. 3 is an enlarged section view taken from line 3—3 in FIG. 1.

The ends 26 and 28 are defined by the ends 50 and 52 of the tubes 24. As best seen in FIG. 3, each end 26, 28 has an outer periphery 54 that includes furrows 56 and elongate, narrow protrusions 58, and each manifold 30, 32 has a wall 60 that extends continuously around the associated end 26, 28 and includes inwardly directed ridges 62 that are received in the furrows 56 and elongate slots 64 that receive the protrusions 58 to provide a tight joint between the wall 60 and the associated end 26, 28. Preferably, the ridges 62 and slots 64 extends longitudinally along the wall 60 a sufficient distance to allow the wall 60 to be pushed over a length of the associated end 26, 28 sufficient to provide an adequately large joining surface between the wall 60 and the associated end 26, 28, thereby allowing for a qualitatively high-grade soldering connection.

Preferably, the interior 34 of each of the tubes 24 includes an insert 65 in the form of a suitable fin or turbulator in order to generate turbulence in the first fluid 33 and achieve efficient heat exchange. However, it should be understood that in some applications it may be desirable for the interiors 34 to be free of inserts. The tubes 24 are each formed by a pair of tube halves 66, as best seen in FIG. 3, in the form of drawn cup plates. Each of the tube halves 66 includes a pair longitudinally extending edge flanges 68. The flange 68 of each tube half 66 mates with the flange 68 of the other tube half 66 to define the protrusions 58. Additionally, each of the tubes 24 has a pair of broad sides 70 and narrow sides 72 that define a generally rectangular cross section, with the broad sides 70 being connected to the narrow sides 72 by rounded corner bends or radiuses 74. Preferably, the central portion of the sides 70 are relieved between the ends 50 and 52 of the tubes 24 so that the broad sides 70 of the adjacent tubes 24 abut each other at the ends 50 and 52 but are spaced from each other at laterally central locations remote from the ends 50 and 52 so as to define the flow path 42 for the second fluid 43. Each of the furrows 56 is defined by the rounded corner bends 74 located at the joint 76 between the ends 50 and 52 of the tubes 24. In this regard, it should be understood that the size of the furrows 56 will depend on the bending radius of the corner bends 74, with smaller bend radiuses leading to smaller furrows 56 and larger bend radiuses leading to larger furrows 56. It should also be appreciated that smaller bend radiuses are harder to produce than larger bend radiuses, but larger bend radiuses have conventionally caused problems for producing an acceptable solder bond with a mating manifold wall. These problems have been overcome by providing the ridges 62 on the wall 60 which essentially fill the furrows 56 and therefore permit tight soldering connections at these sites. Further details of the stack 22, the tubes 24, and the plates 36 and 40 can be found in U.S. Pat. No. 6,250,388 B1, issued to Strahle et al. on Jun. 26, 2001, which shows and describes examples of these components in more detail and which is incorporated herein in its entirety by reference.

Figure 4:
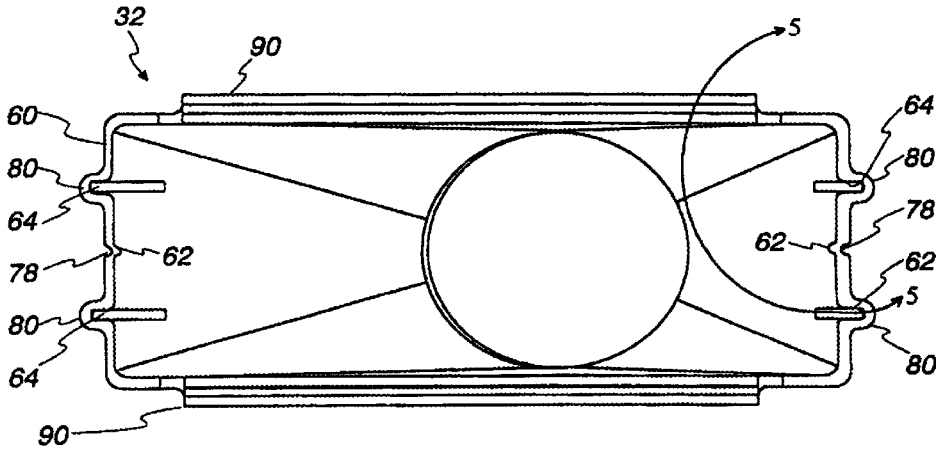
FIG. 4 is an enlarged view a manifold taken from line 4—4 in FIG. 2.
Figure 5:
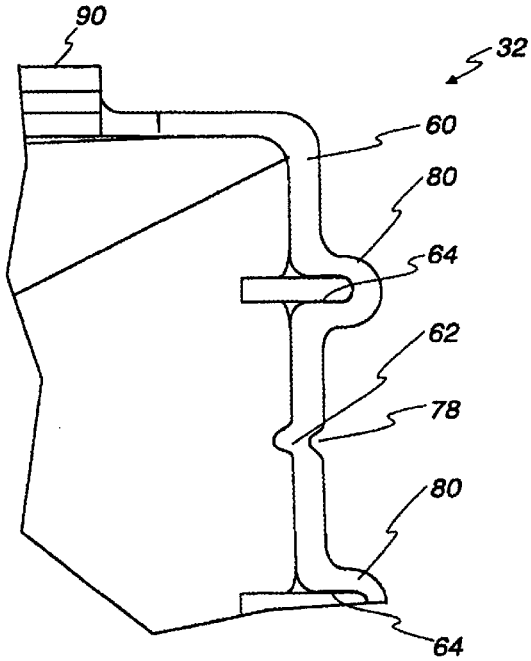
FIG. 5 is an enlarged view of a portion of FIG. 4 indicated by line 5—5.
Figure 6:
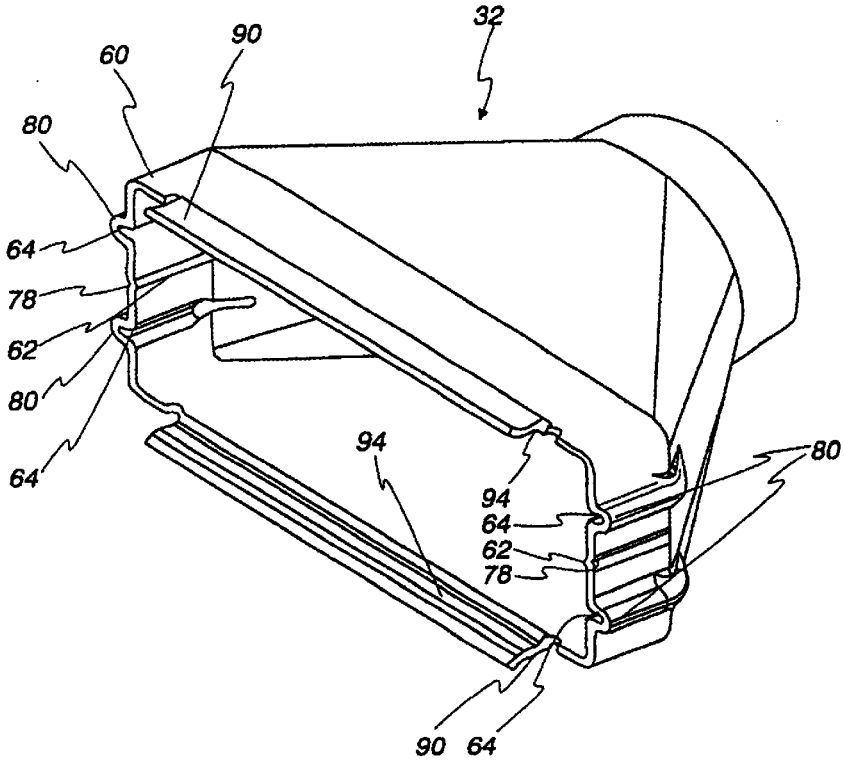
FIG. 6 is a perspective view of the manifold of FIGS. 4–5.
Figure 7:
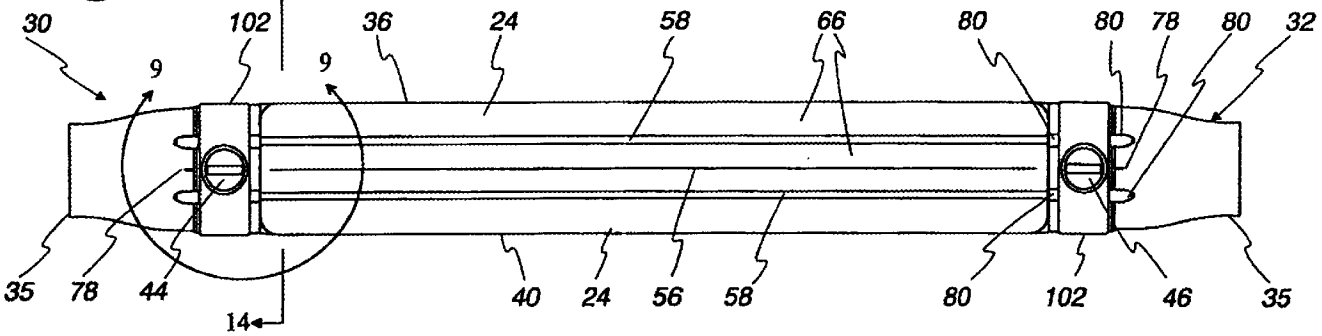
FIG. 7 is a side elevation of an heat exchanger embodying the present invention.
Figure 8:
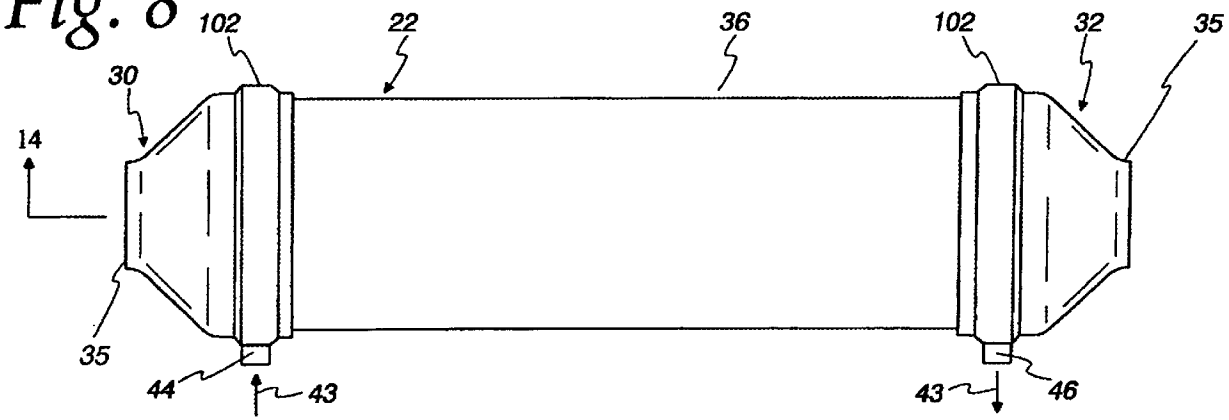
FIG. 8 is a top view, in slightly smaller scale, of the heat exchanger of FIG. 7.
Figure 9:
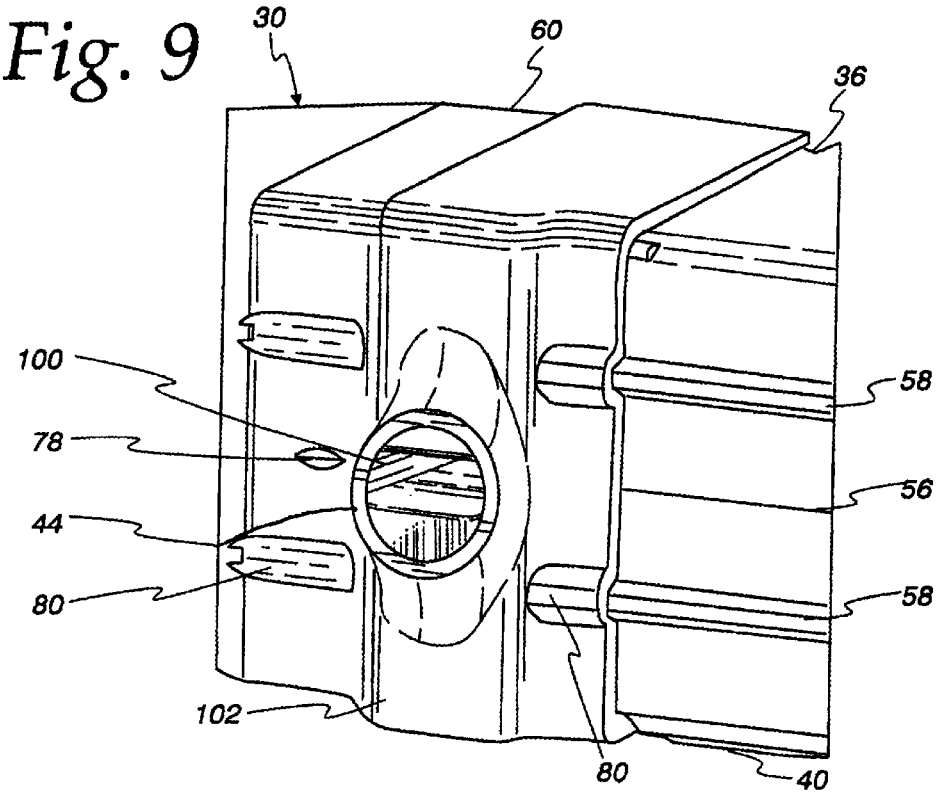
FIG. 9 is an enlarged perspective view of a portion of the heat exchanger of FIG. 7 indicated by line 9—9 in FIG. 7.

Preferably, each of the ridges 62 is defined by an inwardly projecting, deformed indent 78 in the wall 60, and each of the slots 64 is defined by a fold 80 formed in the wall 60, as best seen in FIGS. 4–6. Preferably, the folds 80 are dimensioned so that one of the protrusions 58 fits into the associated slot 64 so that a tight bond joint, such as a tight soldering joint, can be created between the components. In another preferred form, as best seen in the bottom right of FIG. 3, the slot 64 can be provided in the form of a slit 82 that extends through the wall 60 at the location of the fold 80, with the longitudinal depth of the slit depending on how far the respective end 26, 28 is inserted into the respective manifold 30, 32 to achieve a suitable bond joint. Furthermore, depending on the parameters of the particular application, the fold 80 could be eliminated and just the slit 82 could be provided extending through the wall 60. Additionally, it may be desirable in some applications to utilize a combinations of the slits 82 and/or folds 80 with slits 82 and/or folds 80 with non-slitted slots 64.

Each of the manifolds 30 and 32 preferably includes a pair of extensions or flanges 90 extending from the wall 60 to overlay an end 92 of one of the top and bottom plates 36 and 40, as best seen in FIGS. 1 and 2. It is also preferred that each of the flanges 90 include a gradation 94, best seen in FIG. 6, and that each of the ends 92 of the plates 36 and 40 include a pair of tabs 96 that can be bent to engage the gradations 94 of the associated flange 90 to prefix the stack 22 in each of the manifolds 30 and 32 for bonding such as soldering.

In an alternate embodiment, a spacer, to be located at 98 in FIG. 2, can be placed between the broad sides 70 of the adjacent tubes 24, with the spacer 98 roughly corresponding to the height of the flow path 42 for the second fluid 43 between the adjacent tubes 24. If a spacer 98 is used, the ridges 62 may not be required because no furrows 58 may be present in the periphery 54.

Another heat exchanger embodying the invention is shown in FIGS. 7–15, with like reference numbers representing like features from FIGS. 1–6. This embodiment differs from that of FIGS. 1–6 in that the manifolds 30 and 32 define inlet and outlet flow chambers 100 for the second fluid 43 and include ports 44 and 46, rather than the top plate 36 having these features as in FIGS. 1–6. In this regard, an outwardly enlarged or expanded portion 102 is provided in each of the walls 60 to enclose the associated flow chamber 100, with the expanded portion 102 interrupting the slots 64 and associated folds 80. While the illustrated embodiment only shows the ridges 62 and associated indents 78 on a terminal side of each of the expanded portions 102, in some applications it may be desirable to have the ridges 62 and associated indents 78 on both sides of the associated expanded portions 102. Because the illustrated embodiment does on provide the ridges 62 on the entrance side of the expanded portion 102, the corner radiuses 74 are locally made quite sharp at the entrance side locations underlying the wall 60 at the joint 76 between the adjacent tubes 24 so as to essentially eliminate the furrow 56 at this location, as shown at 104 in FIG. 10. This allows for an adequate bond joint between wall 60 and the tubes 24 and this location.

Figure 10:
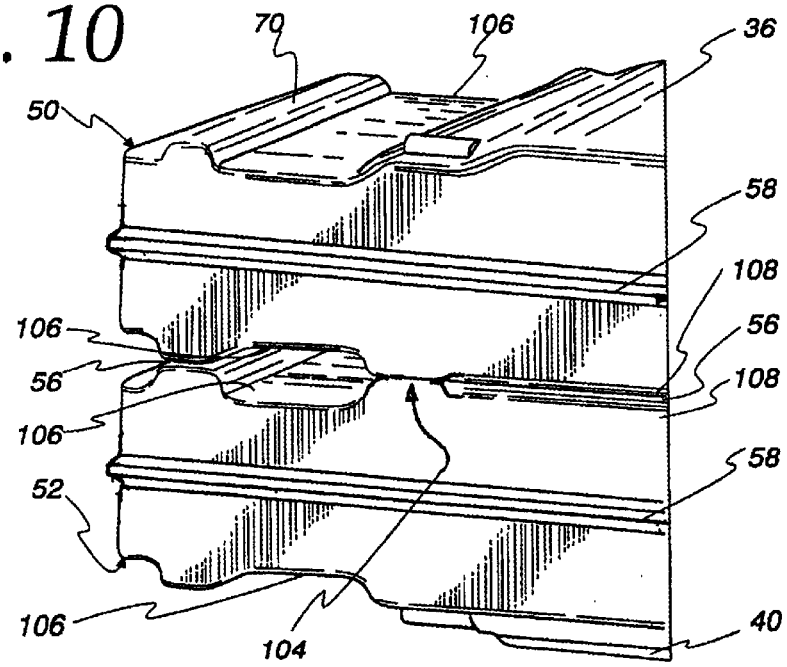
FIG. 10 is a view similar to FIG. 9, but with the manifold of the heat exchanger removed to expose the ends of the heat exchanger's tubes.
Figure 11:
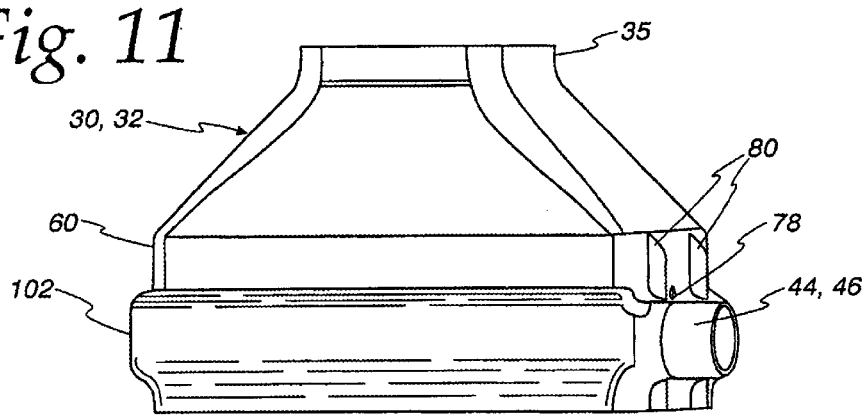
FIG. 11 is an enlarged and rotated perspective view of the manifold of the heat exchanger of FIG. 7.
Figure 12:
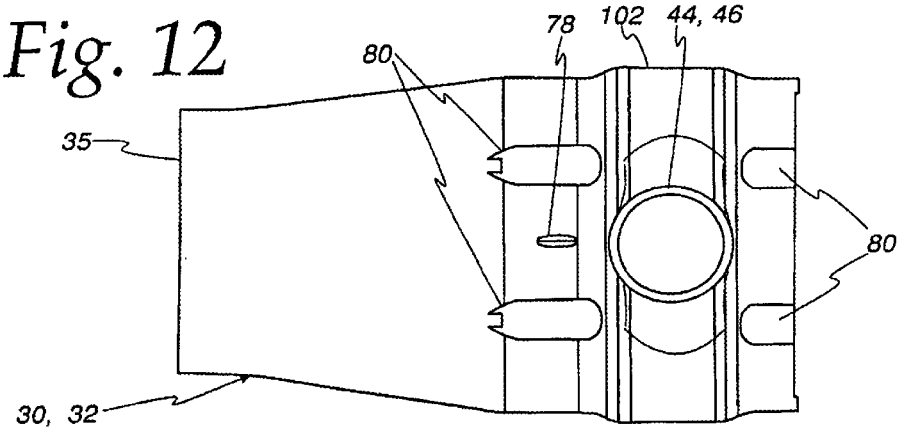
FIG. 12 is an enlarged side elevation of the manifold of FIG. 11.
Figure 13:
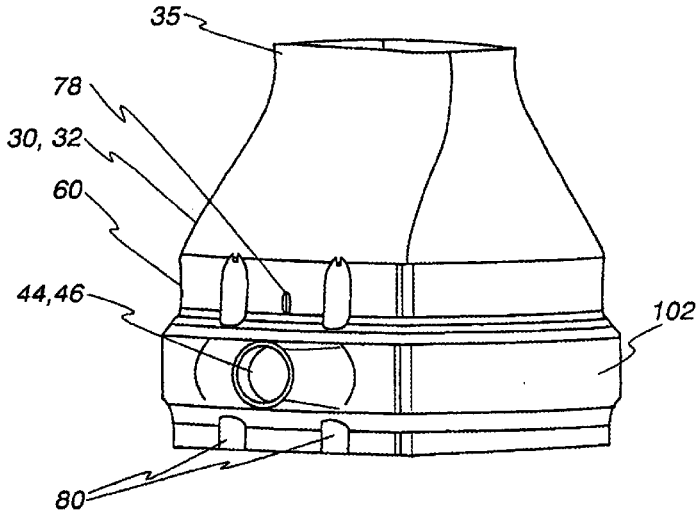
FIG. 13 is a perspective view from another angle of the manifold of FIG. 11.
Figure 14:
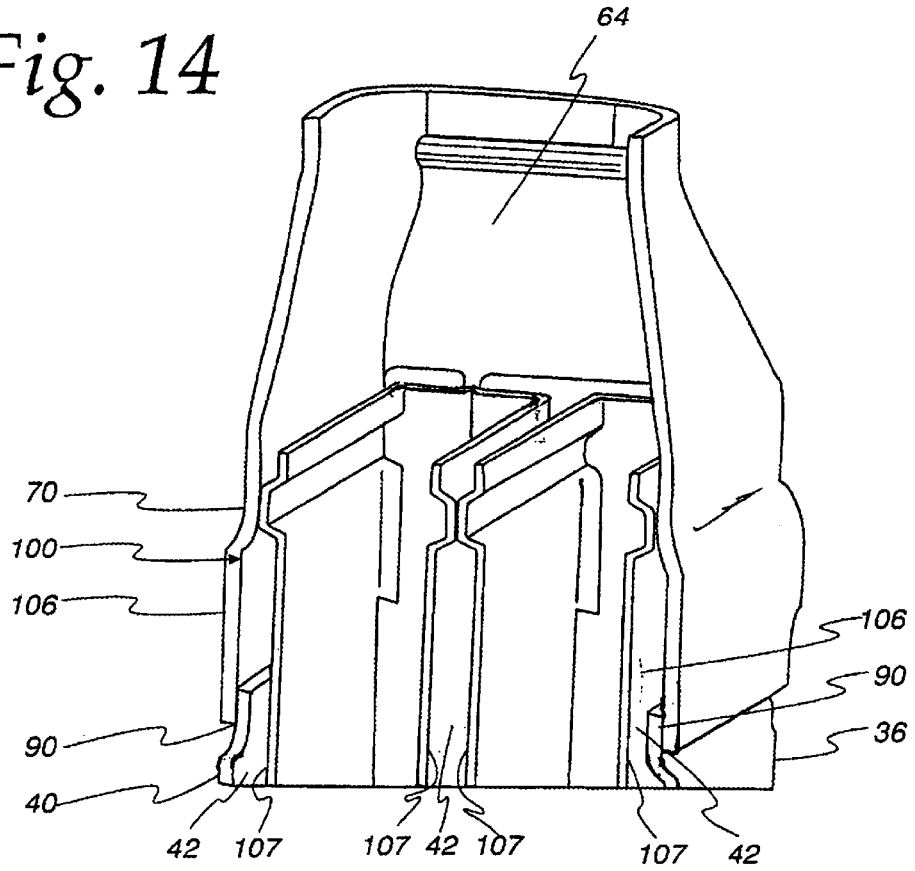
FIG. 14 is a sectioned perspective view of the heat exchanger of FIGS. 7 and 8 taken approximately from lines 14—14 in FIGS. 7 and 8.
Figure 15:
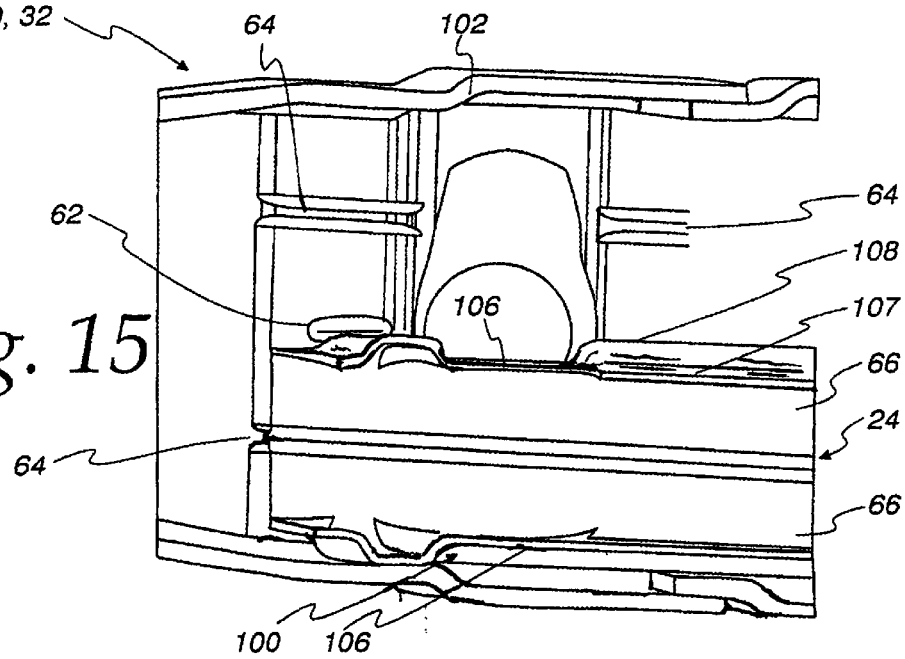
FIG. 15 is view similar to FIG. 14, but rotated and showing the view with one of the heat exchanger tubes removed.

The broad sides 70 of the ends 50 and 52 are locally relieved at 106 across their entire width, as best seen in FIGS. 10, 14 and 15, to define the flow chambers 100 at each end of the heat exchanger 20 in cooperation with the expanded portions 102. In this regard, the unrelieved portion of the broad sides 70 of the adjacent tubes 24 adjacent the relieved portion 106 abut each other and the wall 60 to be bonded thereto to seal the chambers 100 to prevent mixing of the first and second fluids 33 and 43. Additionally, a central portion 107 of each of the broad sides 70 extending between the relieved portions 106 is relieved to define the flow paths 42 for the second fluid 43, with unrelieved, longitudinally extending edge portions 108 of the side 70 abutting each other to seal the flow paths 42 along the length of the heat exchanger 20.

As best seen in FIG. 14, the wall 60 does not have the flanges 90 and the plates 36, 40 do not have the tabs 92 of the embodiment shown in FIGS. 1-6. Rather, the ends 90 of the plates 36 and 40 are relieved so that they can be inserted into the wall 60 to be surrounded thereby together with the stack 22.

While any suitable manufacturing method can be used for the manifolds 30 and 32, it will be advantageous in at least some applications for the manifolds to be produced by deep drawings.

While the outwardly extending flanges 68 of the tube halves 66 are preferred, in some applications it may be advantages for the flanges 68 to extend inwardly, as is known. Such inwardly projecting flanges 68 would eliminate the projections 58 in the periphery 54, but would add additional furrows 56 in the periphery 54 at the joint between the tube halves 66 of each tube 24. As another alternative construction for the tubes 24, in some applications it may be advantages for the tube halves 66 to be U-shaped in cross section so that the arms of one of the tube halves 66 are received in the arms 66 of the other tube half 66, as shown, for example, in DE 39 04 250 C2. With this type of tube joint, shoulders are produced on each lateral side of the tube 24 and, accordingly, on the periphery 54 of the stack 22. For the purposes of this application, such shoulders should be considered as being included in the term furrows.

It should be appreciated that each of the above described constructions for the heat exchanger 20 allow for pre-attachment of the stack 22 and the plates 36, 40 with the manifolds 30 and 32 which can hold the tube halves 66 and plates 36, 40 together during a bonding operation, which is preferably soldering. This can allow for reduced cost in the manufacture of the heat exchanger. Furthermore, because the ridges 62 and slots 64 conform to the furrows 56 and projections 58, respectively, a high-grade or quality bonding connection can be made, particularly for soldering.

What is claimed is:

1. A heat exchanger comprising:

a stack of flat heat exchanger tubes having an end defined by the ends of the tubes of the stack, the end having an outer periphery including at least one of furrows and elongate, narrow protrusions defined by outer peripheries of the ends of the stacked tubes, the tubes having interiors that direct a first fluid through the heat exchanger;

a manifold bonded to the end of the stack to direct said first fluid to or from said interiors of the tubes, the manifold including a wall that extends continuously around the periphery of the end of the stack and is bonded thereto, the wall having integrally formed therein at least one of inwardly directed ridges that are received in said furrows and elongate slots that receive said protrusions to provide a tight joint between the wall and the periphery of the end of the stack.

2. The heat exchanger of claim 1 wherein the periphery of the end of the stack includes both said furrows and said protrusions extending parallel to each other, and said wall includes both said ridges and said slots extending parallel to each other and to said furrows and protrusions.

3. The heat exchanger of claim 1 wherein adjacent pairs of tubes in the stack enclose flow paths for a second fluid through the heat exchanger.

4. The heat exchanger of claim 1 wherein at least one of said slots is defined by a fold in said wall.

5. The heat exchanger of claim 1 wherein at least one of said tubes includes a pair of mating tube halves and at least one of said protrusions is defined by mating edge flanges on said pair of mating tube halves.

6. The heat exchanger of claim 1 wherein at least one of said furrows is defined by a pair of rounded corners located at a joint between said ends of adjacent tubes in the stack.

7. The heat exchanger of claim 1 wherein at least one of said ridges is defined by an inwardly projecting, deformed indent in said wall.

8. The heat exchanger of claim 1 wherein each of the ends of the tubes has a generally rectangular cross-section defined by a pair of parallel, spaced broad sides and a pair of parallel, spaced narrow sides; said the broad sides of said ends of adjacent tubes are abutted against each other, and said ridges and said furrows are located in sections of the wall that extend along the narrow sides of the tubes.

9. The heat exchanger of claim 1 wherein each of the ends of the tubes has a generally rectangular cross-section defined by a pair of parallel, spaced broad sides and a pair of parallel, spaced narrow sides; the broad sides of said ends of each pair of adjacent tubes face each other with a spacer located therebetween.

10. The heat exchanger of claim 1 wherein said manifold is a deep drawn metal component.

11. A heat exchanger comprising:

a stack of flat heat exchanger tubes having an end defined by the ends of the tubes of the stack, the end having an outer periphery including at least one of furrows and elongate, narrow protrusions defined by outer peripheries of the ends of the stacked tubes, the tubes having interiors that direct a first fluid through the heat exchanger;

a manifold bonded to the end of the stack to direct said first fluid to or from said interiors of the tubes, the manifold including a wall that extends continuously around the periphery of the end of the stack and is bonded thereto, the wall having integrally formed therein at least one of inwardly directed ridges that are received in said furrows and elongate slots that receive said protrusions to provide a tight point between the wall and the periphery of the end of the stack; and wherein at least one of said slots is defined by a slit extending through the wall.

12. A heat exchanger comprising:

a stack of flat heat exchanger tubes having an end defined by the ends of the tubes of the stack, the end having an outer periphery including at least one of furrows and elongate, narrow protrusions defined by outer peripheries of the ends of the stacked tubes, the tubes having interiors that direct a first fluid through the heat exchanger;

a manifold bonded to the end of the stack to direct said first fluid to or from said interiors of the tubes, the manifold including a wall that extends continuously around the periphery of the end of the stack and is bonded thereto, the wall having integrally formed therein at least one of inwardly directed ridges that are received in said furrows and elongate slots that receive said protrusions to provide a tight point between the wall and the periphery of the end of the stack;

a top plate overlaying a side of an uppermost tube in the stack and defining an upper surface of the heat exchanger;

a bottom plate overlaying a side of a lowermost tube in the stack and defining a lower surface of the heat exchanger;

and wherein said manifold further comprises a pair of flanges, one of said flanges extending from said wall to overlie an end of the top plate, the other of said flanges extending from said wall to overlie an end of the bottom plate.

13. The heat exchanger of claim 12 wherein at least one of said extensions has a gradation and at least one of said ends of said top and bottom plates has a pair of tabs that are bent to engage the gradation of the associated extension.

14. The heat exchanger of claim 12 wherein said top plate and said side of the uppermost tube enclose a flow path for a second fluid that is directed through the heat exchanger, and said bottom plate and said side of the lowermost tube also enclose a flow path for the second fluid.

15. A heat exchanger comprising:

a stack of flat heat exchanger tubes having an end defined by the ends of the tubes of the stack, the end having an outer periphery including at least one of furrows and elongate, narrow protrusions defined by outer peripheries of the ends of the stacked tubes, the tubes having interiors that direct a first fluid through the heat exchanger;

a manifold bonded to the end of the stack to direct said first fluid to or from said interiors of the tubes, the manifold including a wall that extends continuously around the periphery of the end of the stack and is bonded thereto, the wall having integrally formed therein at least one of inwardly directed ridges that are received in said furrows and elongate slots that receive said protrusions to provide a tight joint between the wall and the periphery of the end of the stack;

adjacent pairs of tubes in the stack enclose flow paths for a second fluid through the heat exchanger; and at least one of said ridges or slots in said wall of said manifold are interrupted along their length by an outwardly expanded portion of said wall, said expanded portion enclosing a chamber for directing the second fluid to or from said flow paths.

16. The heat exchanger of claim 15 wherein a fluid port extends from said expanded portion to direct the second fluid to or from the heat exchanger.

* * * * *

UNITED STATES PATENT AND TRADEMARK OFFICE

CERTIFICATE OF CORRECTION

PATENT NO. : 7,159,650 B2
APPLICATION NO. : 10/610441
DATED : January 9, 2006
INVENTOR(S) : Viktor Brost et al.

It is certified that error appears in the above-identified patent and that said Letters Patent is hereby corrected as shown below:

Column 7, line 43, delete "point" and substitute therefor --joint--.

Column 8, line 6, delete "point" and substitute therefor --joint--.

Signed and Sealed this

First Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,159,650 B2
APPLICATION NO. : 10/610441
DATED : January 9, 2007
INVENTOR(S) : Viktor Brost et al.

It is certified that error appears in the above-identified patent and that said Letters Patent is hereby corrected as shown below:

Column 7, line 43, delete "point" and substitute therefor --joint--.

Column 8, line 6, delete "point" and substitute therefor --joint--.

This certificate supersedes Certificate of Correction issued May 1, 2007.

Signed and Sealed this

Twenty-second Day of May, 2007

JON W. DUDAS
*Director of the United States Patent and Trademark Office*